US005395484A

United States Patent [19]

Odell et al.

[11] Patent Number: 5,395,484

[45] Date of Patent: Mar. 7, 1995

[54] TWIN WIRE WEB FORMER FOR A PAPER MACHINE

[75] Inventors: Michael Odell; Pekka Eväsoja, both of Jyväskylä ; Jyrki Jaakkola, Korpilahti; Jouko Aula, Muurame, all of Finland

[73] Assignee: Valmet Paper Machinery Inc., Helsinki, Finland

[21] Appl. No.: 6,372

[22] Filed: Jan. 19, 1993

[30] Foreign Application Priority Data

Jan. 17, 1992 [FI] Finland ..... 920228

[51] Int. Cl.[6] ..... D21F 1/00; D21F 1/48

[52] U.S. Cl. ..... 162/203; 162/301; 162/352

[58] Field of Search ..... 162/300, 301, 352, 203

[56] References Cited

U.S. PATENT DOCUMENTS

| | | | |
|---|---|---|---|
| 2,881,676 | 4/1959 | Thomas | 162/301 |
| 3,027,940 | 4/1962 | Dunlap | 162/352 |
| 3,403,073 | 9/1968 | Moran | 162/DIG. 7 |
| 4,744,866 | 5/1988 | Koponen et al. | 162/203 |
| 4,988,408 | 1/1991 | Evalahti | 162/301 |
| 5,074,964 | 12/1991 | Partanen | 162/203 |
| 5,167,770 | 12/1992 | Bubik et al. | 162/301 |
| 5,211,814 | 5/1993 | Jaakkola et al. | 162/301 |
| 5,215,628 | 6/1993 | Koivuranta et al. | 162/300 |

FOREIGN PATENT DOCUMENTS

| | | |
|---|---|---|
| 0306759 | 3/1989 | European Pat. Off. . |
| 0397430 | 11/1990 | European Pat. Off. . |
| 0475921 | 3/1992 | European Pat. Off. . |
| 0516601 | 12/1992 | European Pat. Off. . |
| 82084 | 7/1986 | Finland . |
| 892198 | 11/1990 | Finland . |
| 3927597 | 2/1991 | Germany . |
| 9105797 | 7/1991 | Germany . |
| 4014403 | 11/1991 | Germany . |
| 2045827 | 11/1980 | United Kingdom . |
| 2180273 | 6/1988 | United Kingdom . |
| 9102842 | 3/1991 | WIPO . |

*Primary Examiner*—Karen M. Hastings
*Attorney, Agent, or Firm*—Steinberg, Raskin & Davidson

[57] ABSTRACT

The invention relates to a twin-wire web former for a paper machine wherein a covering wire and a carrying wire form a twin-wire forming zone between them. A method for dewatering a web is also disclosed. In the invention, water is drained out of a web running through the twin-wire zone through both of the wires. After the twin-wire zone, the web is separated from the covering wire and is transferred on the carrying wire to a pick-up point. In hybrid formers, after an initial single-wire forming zone preceding the twin-wire zone, and in gap formers, after a curved forming zone placed directly after a forming gap, there is a forming shoe provided with a ribbed deck and arranged inside one of the wire loops. This forming shoe is followed by dewatering and web forming units which include forming ribs and are placed inside both of the wire loops. At least one of the dewatering and web forming units is loaded by means of a pressure-hose arrangement.

25 Claims, 7 Drawing Sheets

TWIN WIRE WEB FORMER FOR A PAPER MACHINE

BACKGROUND OF THE INVENTION

The present invention relates to a twin-wire web former for a paper machine in which a carrying wire and a covering wire define a twin-wire forming zone. A paper web runs through the twin-wire zone such that water is drained out of the web through both of the wires. After the twin-wire zone, the web is separated from the covering wire and is transferred on the carrying wire to a pick-up point.

The present invention relates to both hybrid formers which have a single-wire initial part, and gap formers, in which a pulp suspension jet is fed directly into a forming gap defined by the carrying wire and covering wire.

Further, the present also relates to a method for dewatering a web by running the web through a twin-wire forming zone formed between a carrying wire and a covering wire.

FIELD OF THE INVENTION

In conventional web formers of paper machines, a number of different forming members are used in the twin-wire zone. The principal function of these forming members is to produce a pressure pulsation in the fiber layer or web being formed in the twin-wire zone. The pressure pulsation thus produced promotes the dewatering of the fiber layer or web and also improves its formation.

Moreover, in prior art paper machines, a number of different forming shoes are known and used as the forming members. These types of forming shoes are usually provided with a curved ribbed deck over which the forming wires, e.g. covering wire and carrying wire, are placed together with the web running therebetween. The forming wires and web are curved by the effect of the curved ribbed deck. In the area of these forming shoes, water is removed mainly through the wire placed at the side of the outside curve because of its tensioning pressure. In addition, the dewatering through the outside wire is also aided by a field of centrifugal force produced in proximity to the curved ribbed deck. The ribbed deck of the forming shoe produces a pressure pulsation which promotes the dewatering and improves the formation of the web.

In Finnish Patent Application No. 75,375, corresponding to U.S. Pat. No. 4,744,866, a hybrid former is described in which a twin-wire forming zone is placed substantially and completely above the height level defined by a single-wire initial part. From the height level of the single-wire part, the twin-wire forming zone curves upwards on a sector of a first forming roll.

After initial dewatering has occurred to a suitable extent through the lower wire in the single-wire initial part, further dewatering takes place in the twin-wire dewatering zone. In the twin-wire zone, dewatering will occur on the sector of the first forming roll through both the upper wire and lower wire. In the area of a forming shoe arranged in the twin-wire zone, dewatering takes place primarily upwards through the upper wire. Thereafter, the dewatering pressure is increased further in the area of a second forming roll arranged in the twin-wire zone while the dewatering continues to take place primarily through the upper wire.

In Finnish Patent Application No. 912630, filed May 31, 1991 and corresponding to U.S. Pat. No. 5,211,814, a wire loading device for a paper machine is described. By means of the device described in that patent application, a mechanical load is applied to a wire running in the paper machine, preferably across the entire width of the wire. A pressure pulse is applied to the fiber layer or web placed on support of the wire, or between wires, by means of the mechanical load. The pressure pulse functions to promote dewatering of the web, improve formation of the web, and/or control the transverse profiles of different properties of the web, such as the transverse profiles of dewatering, filler distribution, formation, and/or retention.

In Finnish Pat. Appl. No. 912630, the loading device comprises a plate-shaped spring blade whose side is arranged as substantially parallel to the run of the wire or wires to drag against an inner face of the wire loop to produce a pressure pulse. In addition, the spring blade is attached from outside its dragging area to a frame part of the loading device. A loading force that produces the pressure pulse and curves the spring blade in the machine direction is produced by means of the frame part and/or loading device.

In that patent application, the spring blade extends in a transverse direction of both the web and the wire across their entire width as a unified construction. The spring blade is arranged preferably "with the fur" in relation to the run of the wire and the web, which prevents damage caused by fiber lumps and increases the possibilities of resilience of the spring blade.

The loading device provided with a spring blade is suitable for use in the web former in a number of different positions generally in a twin-wire forming area or, alternatively, in the gap area of a gap former. The loading device described in the patent application permits versatile control and adjustment of the transverse profiles of different properties of the web, wherein, if necessary, closed on-line regulation systems based on measurements of different profiles can be used.

Problems arise if an MB-unit is arranged in the web former in addition to a wire loading device such as that described in Finnish Patent Application No. 912630. The placement of such an MB-unit in a web former is a relatively expensive construction especially in view of modernizations of the wire part of the web former. In the case of modernizations of existing web formers in paper machines, the paper machine would have to be made longer and extended, and most of its frame parts would have to be replaced.

It is a further drawback of the type of MB-units described in that patent application that the change in the tension of the upper wire and of the lower wire is different when compared with one another. This different change in tension between the wires produces a different transverse shrinkage in the wires. The shrinkage produces wrinkle formation in the machine direction with resulting streaks in the web in the machine direction.

OBJECTS AND SUMMARY OF THE INVENTION

It is an object of the present invention to provide a new and improved twin-wire web former by whose means an improved web formation is obtained.

It is another object of the present invention to provide an improvement over the type of hybrid web formers described in Finnish Patent 75,375 and equivalent hybrid formers when the paper grammage is in the range of about 100 g/sq.m such that an advantageous formation and more symmetric structure of the web are obtained.

It is another object of the present invention to provide a hybrid former which is suitable for modernizing the type of formers described in Finnish Patent 75,375 and other equivalent formers such that the dewatering capacity of the web former and properties of web formation are improved and the existing former construction can be utilized as efficiently as possible.

It is a further object of the present invention to provide a new and improved web former in which the wire loading device described in Finnish Patent Application No. 912630 can be used so that the length of a web former can be made shorter than the web former utilized in that patent application.

It is yet another object of the present invention to provide a new and improved web former in which the wire loading device, such as that described in Finish Patent Application No. 912630, is arranged in a web former to enable an MB-unit to also be utilized in the web former such that an even shorter web former will be obtained when compared with prior art web formers.

It is a further object of the present invention to provide for a relatively inexpensive and easy placement of an MB-unit in a web former when modernizing the wire part of a web former such that the paper machine would not have to be extended nor its frame parts replaced.

It is a further object of the present invention to provide a new and improved arrangement of a wire loading device and MB-unit is a web former wherein the drawbacks of prior art web formers are eliminated.

It is yet another object of the present invention to provide a new and improved web former wherein dewatering of the web can be regulated within sufficiently wide limits so that the distribution of fillers and fines in the z-direction of the paper can be controlled.

In connection with the above object, for this purpose, another object of the present invention is that it should be possible, within wider limits than in prior art web formers, to regulate the extent of dewatering taking place in an initial part of a twin-wire forming zone and thereby to permit a sufficiently large proportion of dewatering to take place upward through the upper wire, whereby attempts are made to reduce the anisotropy in the web.

It is still another object of the present invention to provide a new and improved hybrid-former wherein it is possible to drain up to about 50% of the water upwards through the upper wire in the web former.

It is still another object of the present invention to provide a new and improved web former by whose means the extent of upward dewatering can be regulated more advantageously than in prior art web formers.

In view of achieving the objects stated above and others, the invention is characterized in that a twin-wire forming zone of the web former, a forming shoe is arranged inside a wire loop of a carrying wire or a covering wire and provided with a ribbed deck. In hybrid formers, the forming shoe is located after an initial single-wire forming zone whereas in gap formers, the forming shoe is located after a curved forming zone placed directly after the forming gap. The forming shoe is followed, in the running direction of the web, by a wire loading device provided with a spring blade. An intensive pressure pulse is produced in the web by the spring blade to promote formation of the web. The wire loading device is followed, in the running direction of the web, by dewatering units and web forming units which include forming ribs and are arranged inside both of the wire loops. One of the dewatering units or web forming units placed inside the wire loops is loaded, preferably by means of a pressure-medium hose arrangement.

By means of a web former in accordance with the present invention, it is possible to improve the formation of paper accomplished by means of the prior art twin-wire formers and the symmetry of the web in the z-direction. Also, when utilized in hybrid former applications, the present invention provides for the regulation of the quantity of dewatering taking place upwards through an upper wire in the twin-wire forming zone.

In view of practical conditions of the web as it runs through the paper machine, the web former construction of the present invention is more gentler and more stable with respect to the wires because the wire runs over stationary units both before and after the loading unit. In this regard, the present invention can be applied to new upper-wire units in paper machines or to existing upper-wire units which are being modernized.

In the present invention, variations in the tension of the wire can be lower than prior art web formers in corresponding situations where the web former includes MB-units because a low number of MB-units are used in the present invention. Variations in tension may produce the disadvantageous results of wrinkle formation, an increase in the wear of the wires and the formation of holes in the wires.

In a preferred embodiment of the present invention, by means of a spring blade of a wire loading device, an intensive pressure pulse is produced in a relatively short area in the machine direction through the wire into the web that is being formed. With regard to the dimensions of the pressure pulse, the maximum value of the linear load of the pressure pulse is about 2 kN/m, and the length of the pressure area in the machine direction is in the range of about 2 mm to about 10 mm. An optimal linear load is about 1 kN/m. By means of the pressure pulse, the web formation and dewatering are promoted most advantageously at the stage of the process at which the dry solids content (k) of the web is in the range of about 1.5% to about 2.5%, preferably k is about 1.5%.

In addition, by means of the spring blade of a wire loading device fitted in accordance with the invention, it is also advantageously possible to regulate different transverse profiles of the web. These profiles might include the transverse profiles of dewatering, distribution of fillers, formation and/or of retention. The spring blade(s) arranged in the web former is followed by a loading unit which is preferably loaded by a hose and arranged such that water can be drained through it. A loading unit having a fixed rib can be substituted for the fixed ribs arranged in the spring blade(s) in the web former of the present invention. It is not necessary to employ a wire loading device provided with a spring blade in all embodiments of the invention. Other possible loading means and types of wire loading devices may be used in web formers of the present invention.

In another preferred embodiment of the present invention, two forming shoes are arranged inside a loop of the carrying wire. These two forming shoes may be provided with a curved ribbed deck. A draining box is arranged between these forming shoes. The draining box may also be provided with a ribbed deck and arranged such that negative pressure prevails therein. A hose-loaded web forming and loading unit is arranged facing the draining box inside the opposite wire loop, e.g. a loop of the covering wire. Suction boxes arranged in the forming shoes and in the dewatering and web forming units should preferably be connected to and communicate with sources of negative pressure so that the level of negative pressure in each suction box can be regulated individually. This arrangement provides for versatile control of the dewatering of the web and of the web symmetry.

The preferred embodiments of the present invention are found in hybrid formers and particularly in modernizations of hybrid formers.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
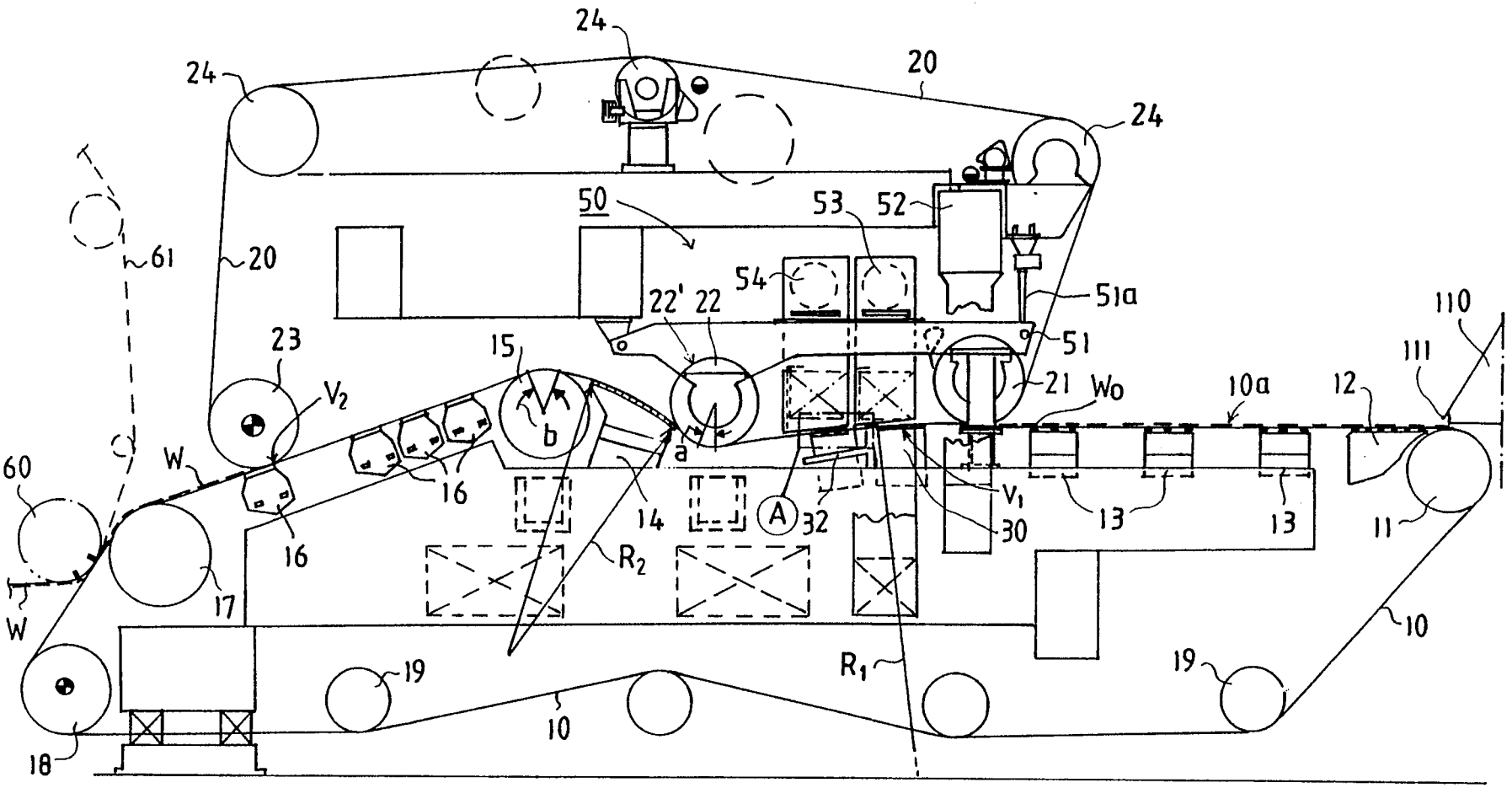
FIG. 1 is a schematic side view of a hybrid former in accordance with the invention used in a method in accordance with the invention.

Referring to FIG. 1, a hybrid web former is illustrated comprising a headbox 110 having a slice 112 through which a pulp suspension is fed onto a substantially horizontal initial part 10*a* of the former formed by a lower wire 10. In the initial part 10*a*, a breast board 12 and foil ribs 13 are arranged. The passage of the lower run of the lower wire 10 is guided by guide rolls 19. The former includes an upper-wire unit 50 having a frame part 51,52 on which rolls 21,22,23,24 are mounted. Rolls 21,22,23,24 determine the run of a loop of an upper-wire 20. Rolls 21 and 22 of the upper-wire unit 50 and suction boxes 53 and 54 are connected to frame part 51. Frame part 51 is connected to the rest of the frame part of the upper-wire unit 50 from above a forming shoe 14 by means of horizontal articulated joints or linkages 51*b*. At an opposite end from linkages 51*b*, the frame part 51 is connected to lifting devices 51*a*. By means of lifting devices 51*a*, the frame part 51 of the upper-wire unit, together with the connected devices mentioned above, can be raised to an upper position, for example, for maintenance work.

Figure 3:
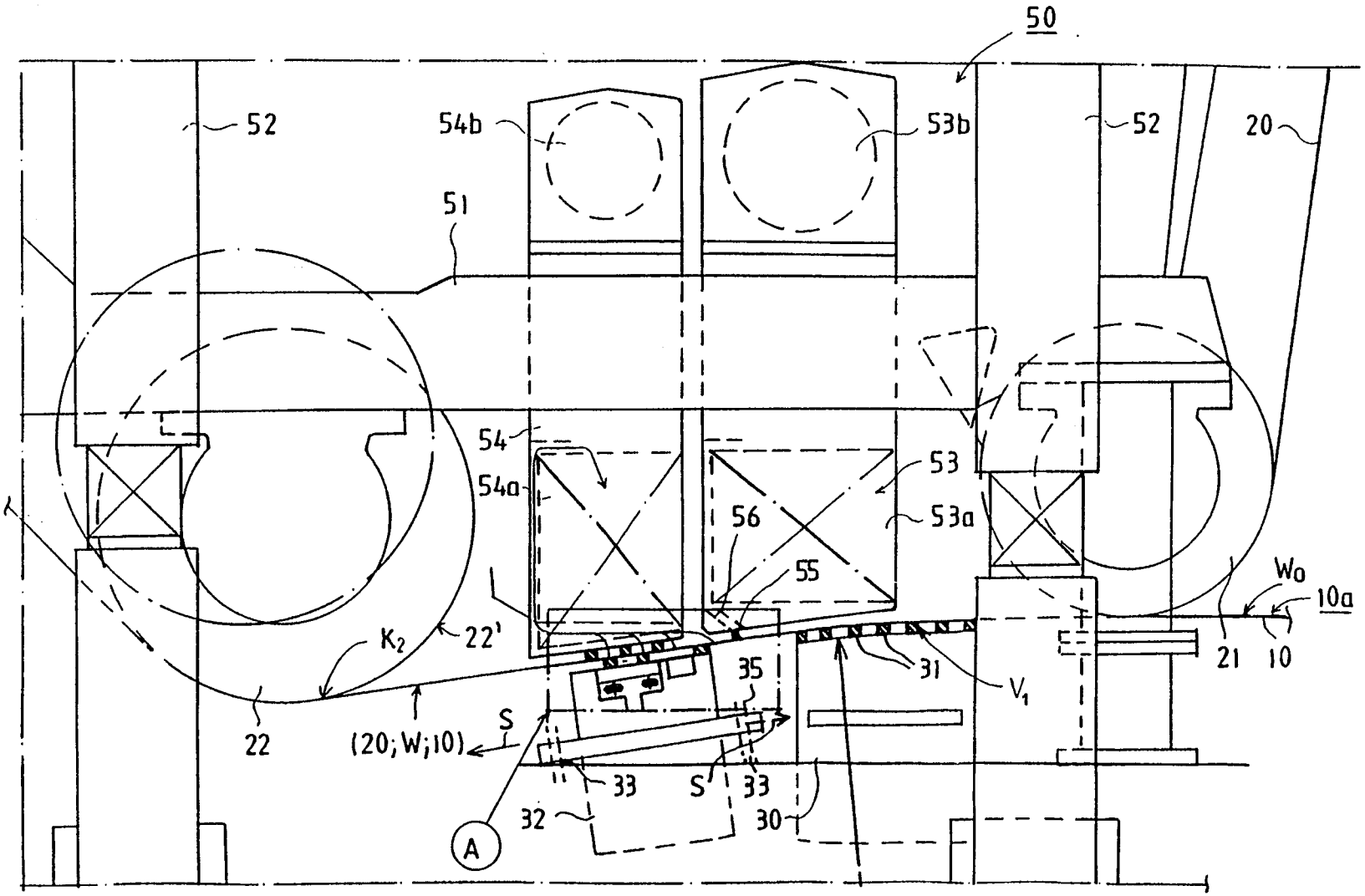
FIG. 3 shows an initial portion of the twin wire former in a hybrid former as shown in FIG. 1.
Figure 4:
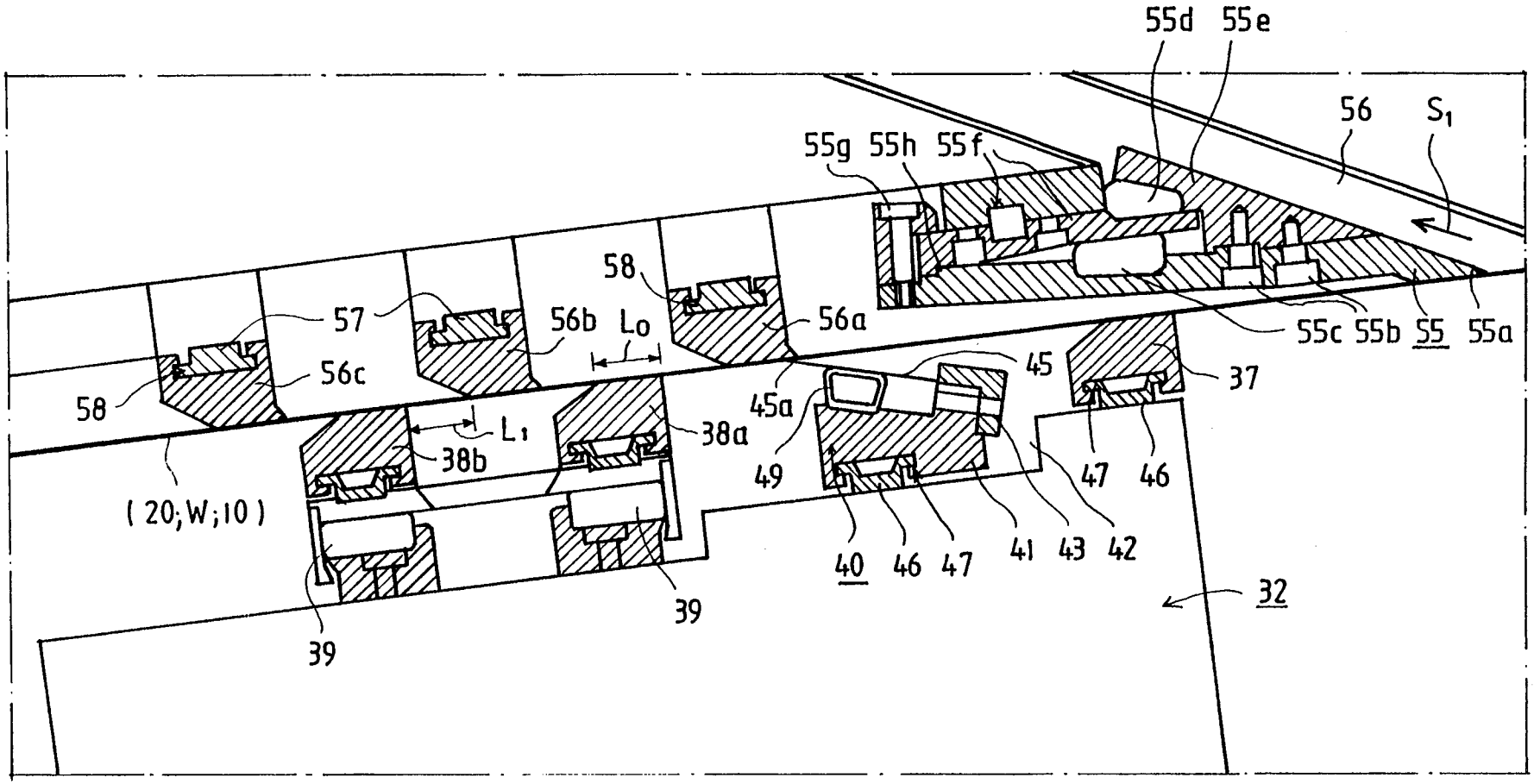
FIG. 4 is an enlarged illustration of the twin-wire forming zone indicated by rectangle A in FIGS. 1 and 3.

In the web former illustrated in FIG. 1, a twin-wire dewatering and forming zone starts at line $V_1$ on a curved box or forming shoe 30 and ends at line $V_2$ on the roll 23. According to FIG. 1, the forming shoe 30 is arranged inside a loop of the lower-wire 10 in the twin-wire zone after the guide roll 21 of the upper wire 20. The forming shoe 30 has a ribbed deck 31 which curves downwards with a curve radius $R_1$. After the forming shoe 30, there is a dewatering foil 55 (FIG. 3) arranged inside the upper-wire loop 20 as shown in FIGS. 3 and 4. A draining duct 56 is placed in front of the dewatering foil 55 and communicates with a suction box 53.

The dewatering foil 55 is followed by a wire loading device 40 in the running direction of the web as shown in FIG. 4. The wire loading device 40 is placed inside the lower-wire loop 20 in a forming unit 32. A spring blade 45 arranged in the wire loading device 40 produces a strong pressure pulse against the inner face of the upper-wire loop 20 which removes water and improves the formation of the web. Forming ribs 56*a*, 38*a*, 56*b*, 38*b*, 56*c* are placed in sequence alternatingly inside the upper-wire and lower-wire loops. Forming ribs 56*a*, 56*b*, 56*c* are connected to the second suction box 54. The loads applied to ribs 38*a* and 38*b* are regulated by means of loading hoses, and the ribs may be interconnected.

Forming unit 32 and suction box 54 are followed by sector a of the forming roll 22, on which sector the run between the upper wire 20 and lower wire 10 turn upwards. After the forming roll 22, there is a short straight joint run of the wires 10 and 20 leading to a forming shoe 14. Forming shoe 14 is followed by a short straight joint run of the wires 10 and 20 and thereafter, forming roll 15 arranged inside the lower-wire loop 10. On a sector b of forming roll 15, the run of the wires 10,20 turns downwards to become a straight run. In this straight run, there are suction flatboxes 16 arranged inside the loop of the lower wire 10 so that by means suction through flatboxes 16, the web W will be directed to follow the lower wire 10. The web W is thereafter separated from the lower wire 10 on the run between rolls 17 and 18 on a suction sector 60*a* of a pick-up roll 60. At the pick-up point 60, the web W is transferred onto a pick-up fabric 61 and then passed to the press section (not shown).

As illustrated in FIGS. 1, 3 and 4, the initial portion 10*a* of the twin-wire forming zone $V_1$–$V_2$ of a hybrid former includes an important feature of the present invention. According to FIG. 3, the web $W_0$ is couched in the single-wire initial part 10*a* so that its dry solids content $k_0$ is in the range of about 1.5% to about 2.5%.

The first guide roll 21 placed inside the upper-wire loop 20 is not a forming roll proper, rather it is preferably a smooth-faced and solid-faced roll. Guide roll 21 is followed by the first forming shoe 30 placed inside the lower-wire loop 10, which forming shoe has a ribbed deck having a large curve radius $R_1$ which curves the twin-wire zone downward. The curve radius $R_1$ of the shoe 30 is generally in the range of about 3 m to about 8 m, preferably $R_1$ is about 5 m. In some applications of the present invention, the forming shoe 30 can be replaced by pre-loading members, such as in a MB-former.

After the forming shoe 30 or equivalent forming member, the web forming unit 32 is arranged inside the lower-wire loop 10 and attached to fastening parts 33 of side frames of the former by means of fastening devices 35. In this manner, the position of the forming unit 32 can be adjusted substantially in the horizontal direction S—S. Two subsequent draining boxes 53 and 54 are arranged inside the upper-wire unit 50, facing the forming shoe 30 and the forming unit 32. These draining boxes 53,54 are connected to sources of negative pressure by means of ducts 53*b* and 54*b*, respectively. At a rear edge of the first draining box 53, a foil rib 55 is arranged having a tip 55*a* which removes water through the upper wire 20 in the direction of the arrow $S_1$ denoted in FIG. 4.

Water is removed from the web W through the upper wire 20 and passes in the direction of the arrow $S_1$ along an upwards inclined duct 56 into the first suction box 53 by the effect of the kinetic energy of the draining water and the effect of the suction of the negative pressure present in the box 53, From the first suction box 53, the water drained from the web W is removed to one side of the former through a draining duct 53*a*.

Foil rib 55 is provided with loading hoses 55*c* and 55*d* arranged to load the foil rib 55 against an inner face of the upper wire 20. The upper hose 55*d* is fixed between a frame piece 55*f* and an upper piece 55*e*. The upper piece 55*e* is fixed to the foil rib 55 by means of screws 55*b*. The rear end of the foil rib 55 is attached to the frame part 55*f* by means of screws 55*g* so that the foil rib 55 can be pivoted around the line 55*h* by regulating the pressures in the hoses 55*c* and 55*d*.

According to FIGS. 3 and 4, the foil rib 55 is followed by a first fixed rib 37 in the forming unit 32 and thereafter by a wire loading device 40 provided with a spring blade 45. The wire loading device and spring blade will be described in more detail later. The loading device 40 is followed in the running direction of the web by a unit consisting of two subsequent loading ribs 38*a* and 38*b*, which unit is loaded by a pair of transverse loading hoses 39. The fixed loading rib 37, a frame part 41 of the wire loading device 40, and the loading ribs 38*a* and 38*b* are all attached to fastening ribs 46 by means of dovetail grooves 47 in each of the devices. In this manner, the loading ribs 37, 38*a* and 38*b* and the wire loading device 40 can be exchanged and/or replaced quickly by pulling them to the side of the former in their longitudinal direction and by arranging new, corresponding parts in their place.

According to FIGS. 3 and 4, a second draining box 54 operates and is arranged facing the forming unit 32 and inside the upper-wire loop 20. A bottom face of the second draining box 54 consists of a plurality of subsequent loading ribs 56*a*, 56*b*, 56*c* . . . , preferably between three and five, which are attached to fastening ribs 57 by means of dovetail grooves 58 in the loading ribs 56*a*,56*b*,56. In this manner, the loading ribs are replaceable quickly by pulling them to the side of the machine and removing them from the web former.

The first rib 56*a* operates in the loading area of the spring blade 45 of the wire loading device 40, in which area a strong pressure pulse is applied to the web W. The second rib 56*b* operates between the ribs 38*a* and 38*b*, and the last rib 56*c* operates after the last rib 38*b* in the forming unit 32. If additional loading ribs are utilized, corresponding forming ribs in the forming unit will also be arranged so that the forming ribs are spaced between the loading ribs.

In the area of the ribs 37, 38*a*, 38*b*, 56*a*, 56*b* and 56*c*, the run of the twin-wire zone is very gently wave-formed with a low amplitude. This wave shape promotes the dewatering and the formation of the web and reduces the tendency of wrinkle formation in the wires 10, 20. The spaces between the ribs 56*a*, 56*b* and 56*c* connect to the negative pressure present in the suction box 54. The level of negative pressure present in the first suction box 53 is in the range of about 0 $mH_2O$ to about 2 $mH_2O$. In the second suction box 54, the level of negative pressure is higher, generally in the range of about 0.4 $mH_2O$ to about 4 $mH_2O$. To achieve this level of negative pressure in the second suction box 54, the second suction box 54 is connected to a suction pump which handles smaller quantities of air than a blower connected to the first box 53 through duct 53*b*.

In connection with the dewatering members described above, it is possible to use a number of different regulation parameters in the present invention, by whose means the dewatering process can be controlled and optimized. These parameters will be described in more detail in the following.

The pressure in a loading hose 49 of the wire loading device 40 is preferably regulated in the range of about 0.5 bars to about 1.5 bars, while the maximum pressure is about 2 bars to about 5 bars. The length of the pressure pulse of the spring blade 45 in the machine direction is generally about 2 mm to about 10 mm. The magnitude of the pressure pulse in the loading area of the spring blade 45 is generally in the range of about 0 kN/m to about 2 kN/m, while an optimal pressure is about 1 kN/m. The pressure in the loading hoses 39 of the forming ribs 38*a* and 38*b* is adjustable, preferably about 0.5 bar.

In order to regulate the dewatering and optimization of the web formation, the positions of the ribs 37, 38*a*, 38*b*, 56*a*, 56*b*, 56*c* in the machine direction and the position of the spring blade 45 of the wire loading device 40 can be adjusted. The length $L_0$ of the dragging area of the loading ribs 37, 38*a*, 38*b*, 56*a*, 56*b*, 56*c* in the machine direction is preferably about 30 mm, and the distance $L_1$ between the ribs in the machine direction is preferably about 25 mm. After the loading area of the blade of the loading device 40, the dry solids content of the web W at the maximum $k_{max}$ is about 4%.

The values and preferred levels of operation given above serve as a guideline. However, one should bear in mind that they depend on the type of raw-material used in the web former and on the paper quality that is being manufactured in the paper machine.

In the area before the forming roll 22 provided with an open hollow face 22', the dry solids content ($k_2$) of the web W placed between the wires 10 and 20 is in the range of about 3% to about 5%. In such a situation, this level of dry solids content indicates that there is almost no more freely moving water remaining in the web W by whose means the formation could be affected. Thus, the formation is produced primarily by means of the single-wire initial part 10*a* of the dewatering zone together with the dewatering and forming members 30, 32, 55, 56*a*, 56*b*, 56*c*, 53, 54. It is characteristic of the construction described above that, by its means, it is possible to remove quite a large proportion of water expressly through the upper wire 20 and thereby compensate for the unevenness of the distribution of fines and fillers that have been produced by the one-sided draining through the lower wire 10 taking place in the single-wire zone 10*a*.

On the sector a of the open face 22' of the forming roll 22 shown in FIG. 1, the dewatering occurs upwards through the upper wire 20 because of the open face 22' of the roll 22 by the effect of compression between the wires 10 and 20. This upward-directed draining takes place on the curved-faced forming shoe 14 as a result of the dewatering that takes place upwards by the effect of the centrifugal force produced by the curve form $R_2$ of the forming shoe 14 and also by the effect of the tension between the wires 10 and 20.

On the sector b of the smooth-faced forming roll 15, the pressure of the dewatering that takes upwards is increased substantially. This is achieved so that the radius of the roll 15 can be selected substantially smaller than, for example, the curve radius $R_2$ of the curved forming shoe 14. On the sector b of the roll 15, the pressure of draining of the water through the upper wire 20 has been dimensioned in maximum proportions so that the radius of the roll 15 determines the dry solids content of the web W. Therefore, suction flatboxes 16 are used to the extent that is necessary to achieve this purpose. However, it is an important principle of the present invention that attempts are made to use a minimum number of suction flatboxes 16, or even to omit them completely when possible, because these dewatering members consume a relatively large amount of energy.

Figures 2, 2A:
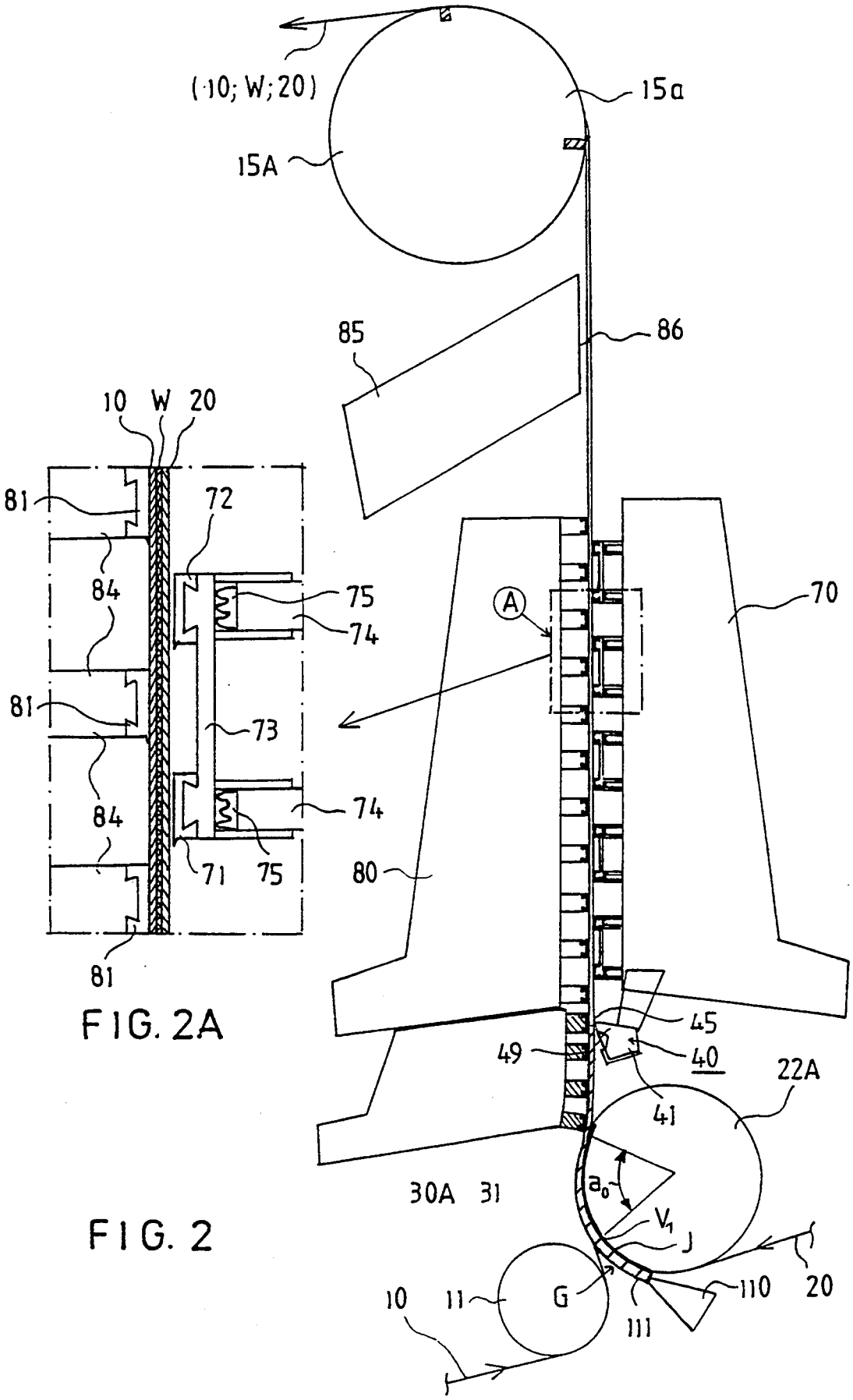
FIG. 2 shows a gap former in accordance with the invention used in a method in accordance with the invention.
FIG. 2A is an enlarged illustration of detail A indicated in FIG. 2.

FIGS. 2 and 2A show a gap former in accordance with the invention, whose twin-wire forming zone runs vertically upwards. The carrying wire 10 and the covering wire 20 are guided by their guide rolls 11,22A and form a forming gap G between them. A pulp suspension jet J is fed out of a discharge opening 111 of a headbox 110 into this forming gap G. At the end of the forming gap G, the twin-wire zone is curved on sector $a_0$ of the forming roll 22A. The magnitude of sector $a_0$ is generally from about 20° to about 45°. After sector $a_0$, the twin-wire zone is separated from the forming roll 22A and continues its run guided by a ribbed deck 31 of a forming shoe 30A arranged inside a loop of the carrying wire 10.

In accordance with the invention, FIGS. 2 and 2A, a wire loading device 40 is arranged after the forming shoe 30A and inside the loop of the covering wire 20. A spring blade 45 in the wire loading device 40 produces a strong pressure pulse against an inner face of the covering wire 20. This pressure pulse is effective at the latest at a first loading rib 84 of an MB-unit 80 arranged inside the loop of the carrying wire 10.

After the spring blade 45 of the loading device 40, there is an MB-unit 70 arranged inside the loop of the covering wire 20 and whose construction is seen in more detail in FIG. 2A. In the MB-unit 70, ceramic loading ribs 71 are arranged in pairs and interconnected by a support construction 73. A unit 72, 73 is loaded against a frame construction 74 by passing pressure into the interior of loading hoses 75. MB-units 70 and 80 may also change places with one another, e.g. MB-unit 70 arranged inside the loop of the carrying wire and MB-unit 80 arranged inside a loop of the covering wire.

Referring to FIG. 2A, ceramic forming ribs 81 of the MB-unit 80 placed inside the loop of the wire 10 are attached to a frame construction 84 by means of dovetail joints. The ribs 81 are arranged alternatingly with respect to the ribs 71, 72 of the MB-unit 70 so that the twin-wire zone runs between the units 70, 80 along a very gently meandering path. In the area of the MB-units 70, 80, the dewatering of the web can be intensified by the effect of the negative pressure prevailing in the gaps between the ribs 71, 72, 81. In respect of the other details of the constructions of the MB-units 70, 80, reference is made to Finnish Patent Applications Nos. 884109, 885607, and 892198.

After the MB-units 70,80, the twin-wire zone proceeds as a vertical run on which a suction flatbox 85 is arranged. Water is sucked out from the web W through the carrying wire 10 and removed through gaps in the ribbed deck 86 of the flatbox 85. The vertical run of the twin-wire zone is curved on a suction zone 15*a* of the second forming roll 15A. Thereafter, the web W is detached from the covering wire 20 and is guided on the carrying wire 10 to the pick-up point (not shown).

In FIGS. 1–4 and mainly in FIG. 4, the details of the construction and the operation of the wire loading device 40 are illustrated. The loading device 40 comprises a thin plate-like spring blade 45 having a tip 45*a* which may be rounded. The spring blade 45 extends as a unified construction across the entire width of the web W and the wires 10,20. The area of the tip 45*a* of the spring blade 45 may be provided with perforations. The spring blade 45 loads and drags against the inner face of the wire 10;20 by means of its wide side. At its opposite edge, the spring blade 45 is attached to a frame part 41 of the loading device 40 by means of a fastening piece 42 and a screw 43. The blade 45 operates as a plate spring so that when it is loaded by one edge and becomes curved, a dragging and loading pressure is produced against the wire 10. The blade 45 is stationary and drags "with the fur" against the wire 10 that it loads. In this manner, the spring blade follows the variations in the thickness of the web transmitted through the wire.

The spring blade 45 of the loading device 40 is made of a restorable, flexible plate-like spring material. The ratio of the length (L) of the spring blade 45 to the thickness (S) of the plate material of the blade is selected within the range of L/S is about 10 to about 1000. Optimal applications are usually found within the range of L/S is about 300 to about 500. The value of the ratio L/S also depends on the material of the spring blade. The material from which the spring blade is manufactured is preferably a wear-resistant spring steel, such as stainless steel. Some plastic materials, composite materials and/or sandwich structures may also be utilized to form the spring blade. The spring blade 45 does not necessarily have to be constructed having a uniform thickness, i.e. it can be of variable thickness, or of the same material or same construction across its entire length or entire width. Variations within the preferable ranges of the ratio L/S are possible.

In operation, when the spring blade 45 is loaded by means of the loading hoses or other loading means 49, the shape of the plate material of the blade in the machine direction can be deflected with a relatively large curve radius of about 200 mm to about 1000 mm depending on the elasticity conditions and loads applied through the loading means. In addition, a sufficiently wide dragging area on the blade 45 against the wire 10 can be produced. Thus, the material of the spring blade 45 must have suitable spring properties which also prevent the production of permanent deformations.

With regard to the dimensions of the spring blade 45, and the spring properties of the material of the spring blade, these are selected so that the elastic constant of the blade deflection per meter of width is in the range of about 0.02 kN/mm to about 0.3 kN/mm, preferably in the range of about 0.06 kN/mm to about 0.12 kN/mm. In particular in composite structures, the elastic constant may be different in the machine direction as compared with the transverse direction.

With regard to operating conditions of the spring blade 45 of the wire loading device 40, the spring blade 45 produces a very intensive pressure pulse whose linear load is generally in the range of about 0.2 kN/m to about 3 kN/m, preferably in the range of about 0.7 kN/m to about 1.2 kN/m. The length of the pressure pulse in the machine direction is relatively short, generally in the range of about 2 mm to about 10 mm, preferably from about 3 mm to about 7 mm. By means of the pressure pulse, the formation of the web W is improved and a strong dewatering effect is produced through the opposite wire from the wire against which the spring blade drags, e.g. in hybrid former applications through the upper wire 20. The pressure pulse has the most advantageous effect on the dewatering and formation of the web when the dry solids content (k) of the web is in the range of about 1.2% to about 3%, preferably k is about 1.5% to about 2%.

When the distribution of the linear load of the spring blade 45 of the loading device in the transverse direction is regulated, for example, by means of the regulation devices described in Finnish Patent Application No. 912630, it is also possible to control the transverse profiles of different properties of the web W. These properties include the transverse profiles of dewatering, distribution of fillers, formation, and/or of retention.

Figure 5:
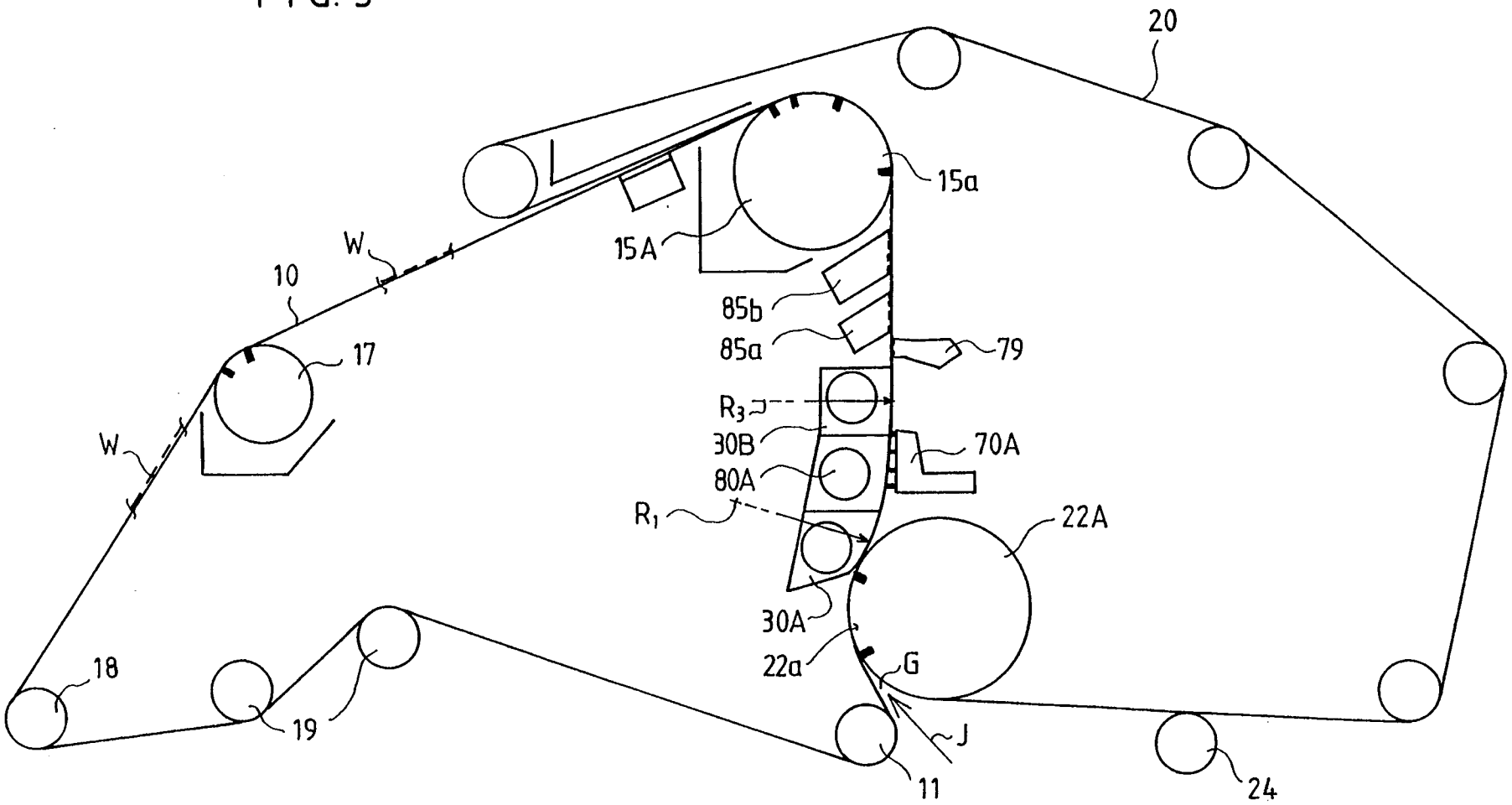
FIG. 5 shows a preferred embodiment of a vertical gap former in accordance with the invention used in a method in accordance with the invention.
Figure 6:
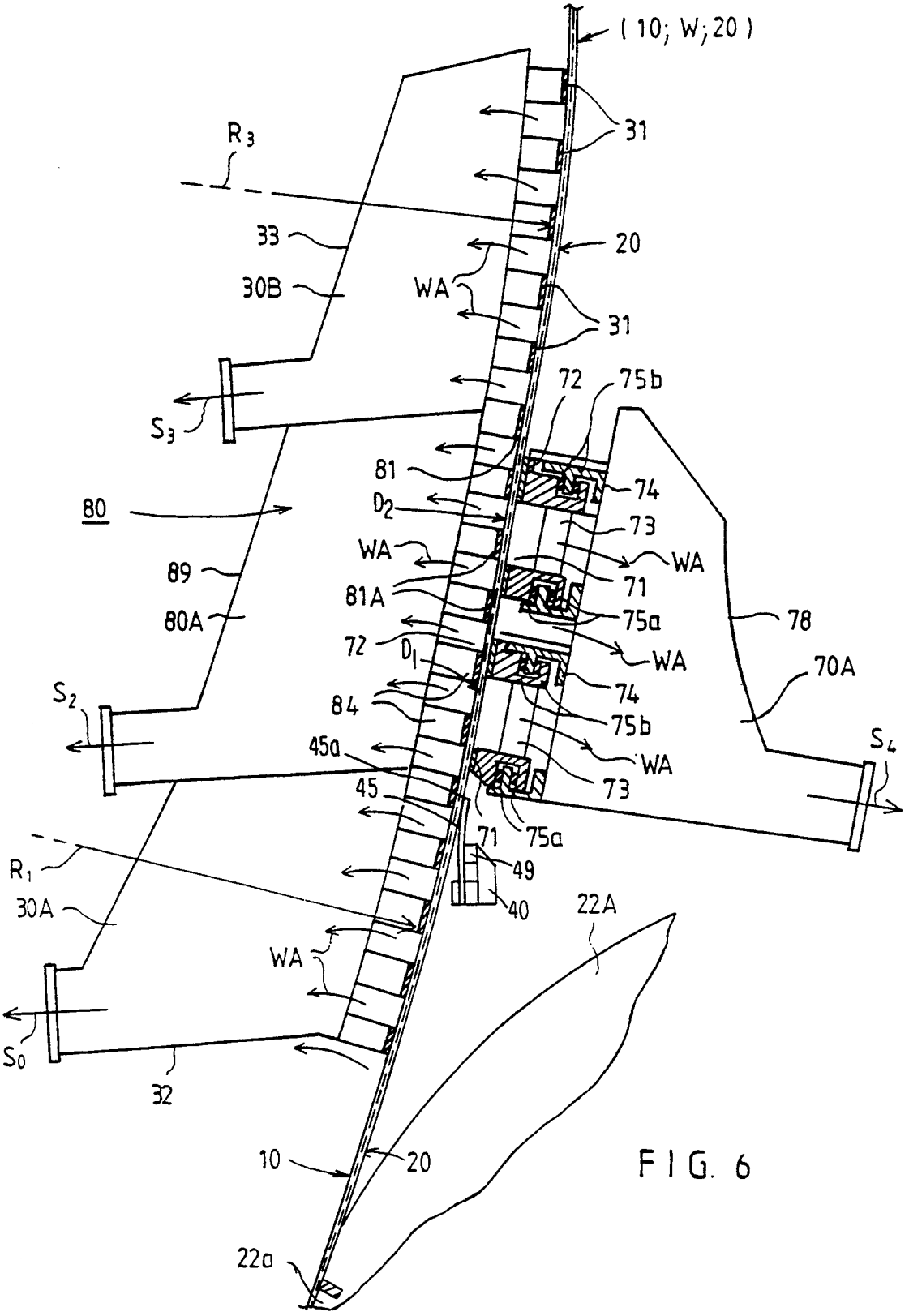
FIG. 6 shows an initial portion of a twin-wire forming zone in a former as shown in FIG. 5 on an enlarged scale.

FIGS. 5 and 6 show formers that are in many respects similar to that shown in FIGS. 2 and 2A. In this respect, reference is made to the description related to FIGS. 2 and 2A, and the additional and/or different features of the formers as shown in FIGS. 5 and 6 will now be described. Some of these additional features differ from those illustrated in FIGS. 2 and 2A. The formers shown in FIGS. 5 and 6 may be provided with a wire loading device 40.

In the web formers illustrated in FIGS. 5 and 6, the twin-wire zone has a short straight run after the forming roll 22A. The straight run is followed by a forming shoe 30A provided with a ribbed deck 31 similar to what has been described above with respect to FIGS. 2 and 2A. The suction box 32 of the forming shoe 30A communicates with a source of negative pressure, such as a suction pump, which is illustrated by arrow $S_0$. The ribbed deck 31 of the forming shoe 30A has a curve radius $R_1$ is about 3 m to about 8 m, preferably $R_1$ is about 5 m.

The suction box of the forming shoe 30A is directly connected with a first suction box 89 in the MB-unit 80A. The first suction box 89 is connected to a source of negative pressure as illustrated by arrow $S_2$. The suction box 89 is provided with a ribbed deck 81, which has an initial portion which guides the twin-wire zone along a straight run $D_1$ up to the forming rib 81A. The forming rib 81A is placed substantially in the middle of the suction box 89. Ribs on the ribbed deck 81 are mounted in such a way that, with respect to a first straight run $D_1$, the twin-wire zone will be guided along a second straight run $D_2$. Between the straight runs $D_1$, $D_2$, there is a small deflection angle of a few degrees, whose "tip" is placed facing the rib 81A so that the twin-wire zone has a non-linear path in its entire run through the MB-unit 80A.

Suction box 89 of MB-unit 80A is followed almost immediately by or connected to a second forming shoe 30B, whose suction box 33 communicates with a source of negative pressure illustrated by arrow $S_3$. Ribs 31 on a guide deck of the second forming shoe 30B are placed so that the forming shoe 30B guides the twin-wire zone with the curve radius $R_3$, which has the same direction as the curve radius $R_1$ of the first forming shoe 30A. The curve radius $R_3$ is selected substantially equal to, or somewhat larger than, the curve radius $R_1$. Opposite to MB-unit 80A on the other side of the twin-wire zone, MB-unit 70A is arranged inside the loop of the covering wire 20. Suction box 78 in MB-unit 70A is connected to and communicates with a source of negative pressure illustrated by arrow $S_4$.

In the MB-unit 70A, the ribs 71, 72 operate against the inner face of the wire 20 and are loaded by pairs of pressure medium hoses **75*a*, 75*b*. The ribs 71,72 are also interconnected in pairs by means of intermediate parts 73 in the manner shown in more detail in FIG. 2A. The operation of the MB-unit 80A, 70A is, in other respects, similar to that described above in relation to FIGS. 2 and 2A**.

According to FIG. 5, the second forming shoe 30B is followed by a suction flatbox 79 arranged inside the loop of the covering wire 20 and, thereafter, by two suction flatboxes **85*a* and 85*b* arranged inside the loop of the carrying wire 10. After suction flatboxes 85*a*,85*b*, the construction and the run of the web W are similar to that described in relation to FIG. 1. In FIGS. 5 and 6**, the directions and routes of dewatering of the web are illustrated by arrows WA.

Figure 7:
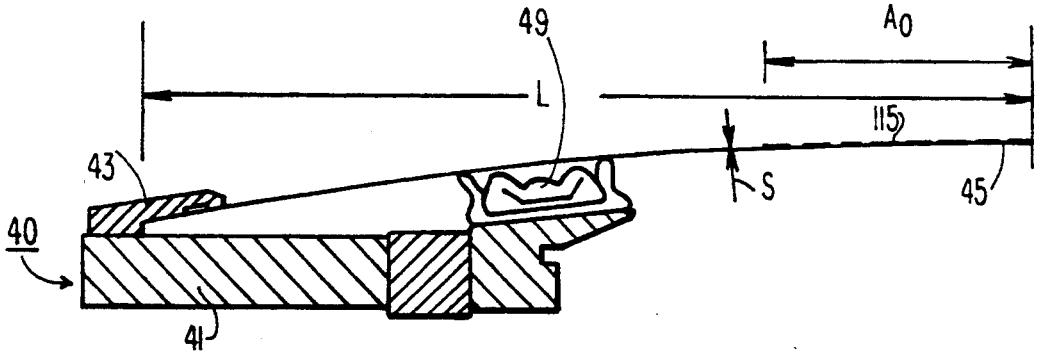
FIG. 7 shows a vertical cross-section view in the machine direction of a wire loading device used in a web former in accordance with the invention.

Referring to FIG. 7, in a preferred embodiment, the area of the spring blade 45 that will load and drag against the wire 10;20 can be provided with a wear piece or a wear-resistant coating, e.g. with a ceramic layer. This wear-resistant coating is represented by the dashed line denoted with reference numeral 115 and is arranged on the spring blade 45 over a length of the loading area $A_0$ of the blade in the longitudinal direction of the blade.

Figure 8:
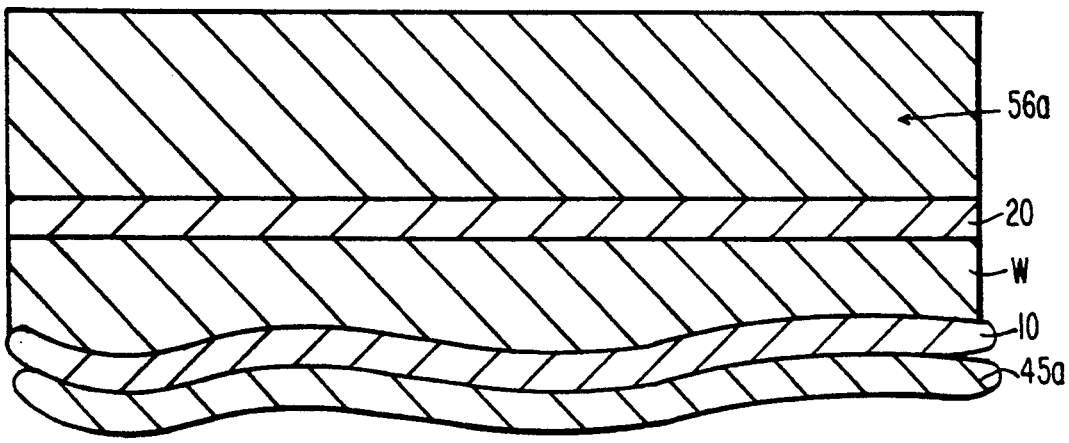
FIG. 8 illustrates the cross-sectional view of a spring blade acting against a loading rib in a wire loading device arranged in a web former in accordance with the invention.

Referring to FIG. 8, a cross-sectional view of the area of the web in proximity to the point where the spring blade 45 acts on the carrying wire is illustrated. The tip **45*a* of the spring blade 45 "drags with the fur", i.e. follows variations in the thickness of the web. This results from the selection of the dimensions of the spring blade parameters of length (L) and thickness (S) in a specific proportion. The flexibility of the spring blade tip 45*a* provides a substantial conformity in the pressing of the spring blade 45 against the inner face of the carrying wire 10. The web runs W between the carrying wire 10 and the covering wire 20 and may have variations in its thickness as a result of non-uniform formation. The first loading rib 56*a* is arranged on the other side of the covering wire 20** from the web W. In this manner, the pressure pulse provides for an advantageous improvement in formation and dewatering of the web.

Other features of the spring blade are described at length in U.S. Pat. No. 5,211,814, the specification of which is incorporated herein. In certain preferred embodiments, the spring blade is a Sym-Pulse® blade commercially available from Valmet Paper Machinery Inc.

The examples provided above are not meant to be exclusive. Many other variations of the present invention would be obvious to those skilled in the art, and are contemplated to be within the scope of the appended claims.

We claim:

1. A web former in a paper machine, comprising a forming roll, a carrying wire and a covering wire defining a twin-wire forming zone in which a web is dewatered beginning at said forming roll, said carrying wire and said covering wire running in a curved path over a sector of said forming roll, the web being separated from said covering wire after said twin-wire zone and transferred on said carrying wire to a pick-up point, a first forming shoe provided with a curved ribbed deck for guiding said twin-wire zone along a curved path, said first forming shoe being arranged inside a loop of said covering wire or inside a loop of said carrying wire and having a direction of curvature opposite to the direction of curvature of said forming roll, a dewatering unit comprising forming ribs and arranged after said first forming shoe inside the same wire loop as said first forming shoe, a web forming unit comprising forming ribs and arranged opposite said dewatering unit inside the other of said wire loops from said dewatering unit, loading means for loading said forming ribs in at least one of said dewatering unit or said web forming unit, said loading means comprising a pressure-medium hose arrangement, and a second forming shoe arranged after said dewatering unit and said web forming unit in the running direction of the web, said second forming shoe having a curved ribbed deck for guiding said twin-wire zone along a curved path, at least one of said forming ribs in said dewatering unit being arranged to deflect said twin-wire zone such that said twin-wire zone has a first substantially straight run before the deflection and a second substantially straight run after the deflection between said dewatering unit and said web forming unit.

2. The web former of claim 1, further comprising a spring blade wire loading device arranged after said first forming shoe and inside one of said wire loops, said spring blade producing an intensive pressure pulse in the web.

3. The web former of claim 2, wherein the linear load of the pressure pulse produced by said spring blade is from about 0.2 kN/m to about 3 kN/m, and/or wherein the length of the pressure pulse produced by said spring blade in a machine direction is from about 2 mm to about 10 mm.

4. The web former of claim 3, wherein the linear load of the pressure pulse produced by said spring blade is from about 0.7 kN/m to about 1.2 kN/m, and/or wherein the length of the pressure pulse in the machine direction is from about 3 mm to about 7 mm.

5. The web former of claim 2, wherein said wire loading device is arranged in an area in which the dry solids content of the web is from about 1.2% to about 3% such that by means of the pressure pulse produced by said spring blade in said wire loading device, the formation of the web is improved and the dewatering of the web is promoted.

6. The web former of claim 5, wherein said wire loading device is arranged in an area in which the dry solids content of the web is from about 1.5% to about 2%.

7. The web former of claim 2, wherein the linear load of the pressure pulse of said spring blade is adjustable in a transverse direction in order to control profiles of dewatering of the web, distribution of fillers in the web, formation of the web, and/or retention of water in the web in the transverse direction.

8. The web former of claim 1, wherein said ribbed deck has a radius of curvature in a range of about 3 m to about 8 m.

9. The web former of claim 8, wherein the radius of curvature of said curved ribbed deck is about 5 m.

10. The web former of claim 2, wherein said first forming shoe and said wire loading device are arranged inside said loop of said carrying wire.

11. The web former of claim 2, wherein said first forming shoe is arranged inside said loop of said carrying wire, and said wire loading device is arranged inside said loop of said covering wire.

12. The web former of claim 2, wherein said spring blade is structured and arranged to follow variations in the thickness of the web.

13. The web former of claim 1, wherein said ribbed deck of said second forming shoe is arranged to guide said twin-wire zone in the same direction of curvature as said first forming shoe.

14. The web former of claim 1, further comprising a first suction box arranged on said first forming shoe and connected to a source of negative pressure, a second suction box arranged on said second forming shoe and connected to a source of negative pressure, additional suction boxes arranged on said dewatering unit and said web forming unit and connected to a source of negative pressure, and control means for controlling the dewatering of the web in said twin-wire zone by adjusting the level of negative pressure in said suction boxes.

15. The web former of claim 1, wherein said dewatering unit includes a ribbed deck arranged between said first and second forming shoes, said ribbed deck having a middle area wherein said twin-wire zone changes direction.

16. The web former of claim 1, wherein the first forming shoe is connected to a first end of the dewatering unit and the second forming shoe is connected to a second end of the dewatering unit opposite to the first end, the second forming shoe having the same direction of curvature as the first forming shoe.

17. The web former of claim 1, wherein the at least one forming rib of the dewatering unit is arranged substantially in a middle position in the dewatering unit between a first end of the dewatering unit and a second end of the dewatering unit opposite to the first end, the forming ribs of the dewatering unit comprising a first set of ribs situated between the at least one forming rib and the first end of the dewatering unit and a second set of ribs situated between the at least one forming rib and the second end of the dewatering unit, the first set of ribs arranged to guide the twin-wire zone in said first run, the second set of ribs arranged to guide the twin-wire zone in said second run, the at least one forming rib providing a small deflection angle between the first run and the second run.

18. A method for dewatering a web in a web former comprising the steps of:

forming a web in a twin-wire forming zone between a carrying wire and a covering wire in proximity to a forming roll arranged inside a loop of one of the wires, draining water out of the web through both the carrying wire and the covering wire, arranging a first forming shoe having a curved ribbed deck in an initial portion of the twin-wire zone and inside a loop of the carrying wire or inside a loop of the covering wire, guiding the twin-wire zone along a curved path formed by the first forming shoe in a direction of curvature opposite to the direction of curvature of the forming roll, arranging a dewatering unit after the first forming shoe in the running direction of the web inside the same wire loop as the first forming shoe, arranging a web forming unit opposite the dewatering unit inside the other of the wire loops from the dewatering unit, providing the dewatering and web forming units with forming ribs, loading the forming ribs in at least one of the dewatering unit or the web forming unit by means of pressure-medium hose arrangements arranged inside either the loop of the carrying wire or the loop of the covering wire, deflecting the twin-wire zone about one of the forming ribs in the dewatering unit such that the twin-wire zone has a first substantially straight run before the deflection and a second substantially straight run after the deflection between the dewatering unit and the web forming unit, arranging a second forming shoe having a curved ribbed deck after the dewatering and web forming units in the running direction of the web, guiding the twin-wire zone along a curved path formed by the ribbed deck, separating the web from the covering wire after the twin-wire zone so that the web runs on the carrying wire, and transferring the web on the carrying wire to a pick-up point where the web is detached from the carrying wire.

19. The method of claim 18, further comprising arranging a spring blade wire loading device after the first forming shoe in the running direction of the web, and producing a pressure pulse in the web by means of the spring blade such that the formation of the web is improved and the dewatering of the web is promoted.

20. The method of claim 19, further comprising adjusting a linear load of the pressure pulse produced by the spring blade in a transverse direction in order to control profiles of dewatering of the web, distribution of fillers in the web, formation of the web, and/or retention of water in the web in the transverse direction.

21. The method of claim 19, further comprising arranging the forming shoe and the wire loading device inside the loop of the carrying wire.

22. The method of claim 19, further comprising arranging the forming shoe inside the loop of the carrying wire and arranging the wire loading device inside the loop of the covering wire.

23. The method of claim 19, further comprising constructing the spring blade from a flexible material such that the spring blade follows variations in the thickness of the web.

24. The method of claim 18, further comprising providing the first and second forming shoes with suction boxes connected to a source of negative pressure, providing the dewatering and web forming units with suction boxes connected to a source of negative pressure, and controlling the dewatering of the web by adjusting the level of negative pressure in the suction boxes in the forming shoes and dewatering and web forming units.

25. The method of claim 18, further comprising providing the dewatering unit with a ribbed deck, and arranging the forming ribs on the dewatering unit in relation to one another such that the direction of the twin-wire zone is changed in a middle area of the ribbed deck.

* * * * *